US005386607A

United States Patent [19]

Sebor

[11] Patent Number: 5,386,607

[45] Date of Patent: Feb. 7, 1995

[54] GROUND ENGAGING MEANS FOR A SUBMERSIBLE CLEANING DEVICE

[76] Inventor: Pavel Sebor, 45 Highcliff Way, Northcliff Extension 12, Johannesburg, Transvall, South Africa

[21] Appl. No.: 131,318

[22] Filed: Oct. 4, 1993

Related U.S. Application Data

[63] Continuation of Ser. No. 880,662, May 11, 1992, abandoned.

[30] Foreign Application Priority Data

Feb. 28, 1992 [ZA] South Africa ..... 92/1504

[51] Int. Cl.[6] ..... F04H 3/20

[52] U.S. Cl. ..... 15/1.7; 15/400; 15/398

[58] Field of Search ..... 15/1.7, 387, 397, 398, 15/400, 402, 404

[56] References Cited

U.S. PATENT DOCUMENTS

| | | | |
|---|---|---|---|
| 1,844,915 | 2/1932 | Nielsen | 15/398 |
| 2,594,189 | 4/1952 | MacFarland | 15/400 |
| 2,977,613 | 4/1961 | Mikutas | 15/1.7 |
| 3,085,267 | 4/1963 | Jacuzzi | 15/1.7 |
| 3,117,338 | 1/1964 | Stevens | 15/400 |
| 4,023,227 | 5/1977 | Chauvier | 15/404 |
| 4,176,419 | 12/1979 | MacDonald | 15/1.7 |
| 4,275,474 | 6/1981 | Woodard | 15/1.7 |
| 4,498,206 | 2/1985 | Braukmen | 15/1.7 |
| 4,536,908 | 8/1985 | Raubenheimer | 15/1.7 |
| 4,692,956 | 9/1987 | Kassis | 15/1.7 |
| 4,763,378 | 8/1988 | Drumm | 15/146 |
| 4,962,559 | 10/1990 | Schuman | 15/1.7 |
| 5,044,034 | 9/1991 | Iannucci | 15/1.7 |

FOREIGN PATENT DOCUMENTS 476413 3/1992 European Pat. Off. .

*Primary Examiner*—David A. Scherbel
*Assistant Examiner*—Gary K. Graham
*Attorney, Agent, or Firm*—Allen, Dyer, Doppelt, Franjola & Milbrath

[57] ABSTRACT

A submersible cleaner relying upon the to and fro motion of an oscillator for forward movement over a submerged surface has a housing with a peripheral edge, an oscillator rotatably affixed to the housing and bristle elements extending away from the skirt at an angle for imparting the forward movement to the cleaner during the to and fro motion with the angular relationship of the bristles being greater at the trailing edge than at the leading edge. The cleaner also employs impact-absorbing buffer formations affixed at the leading edge so as to absorb impacts during the to and from motion.

8 Claims, 2 Drawing Sheets

GROUND ENGAGING MEANS FOR A SUBMERSIBLE CLEANING DEVICE

This is a continuation of co-pending application Ser. No. 07/880,662 filed May 11, 1992 now abandoned.

This invention relates to a ground engaging arrangement for a submersible cleaning device or the like.

It is an object of the present invention to provide a novel ground engaging skirt of bristles for a submersible cleaning device which it is believed will facilitate the movement and in particular the climbing ability of the cleaning device.

According to one aspect of the invention a ground engaging skirt for a cleaning device comprises a skirt formation extending at least partially around the periphery of the device characterised in that the leading edge of the skirt is linear along a substantial length thereof. Preferably the trailing edge of the skirt will also be linear.

Further according to the invention the cleaning device performs an oscillating to and fro motion and the leading edge of the skirt is disposed substantially at right angles to the direction of the oscillating movement. Preferably the skirt will be formed by a curtain of bristle elements adapted to engage the submerged surface.

Where the cleaning device performs an oscillating motion as set out above, the bristles will be angled rearwardly relative to the direction of travel of the device, and it is a further feature of the invention that the bristle curtain at the leading edge will be angled to a lesser degree than that of the trailing edge. Thus for example the bristles at the leading edge will be angled between 0° and 15° and those at a trailing edge at between 5° and 30°. Preferably, the bristles of the leading edge will be angled at 5°, and those at the trailing edge at around 20° to the vertical.

In a preferred arrangement the skirt will have an oblong configuration defining a linear leading edge, a linear trailing edge and side edges which may be rounded and which are of a lesser length than the leading and trailing edges.

Further according to the invention the curtain of bristles is secured to an oblong ring-like holder which will in turn be removably secured to the cleaning device to permit replacement.

Still further according to the invention the ring-like holder includes opposed buffer formations against which an oscillator of the cleaning device strikes alternatively during is oscillating movements. The buffer formations thus protect the cleaning device against damage resulting from the action of the oscillator.

In order to more clearly illustrate the invention an embodiment thereof is described hereunder purely by way of example with reference to the accompanying drawings wherein.

Figure 1:
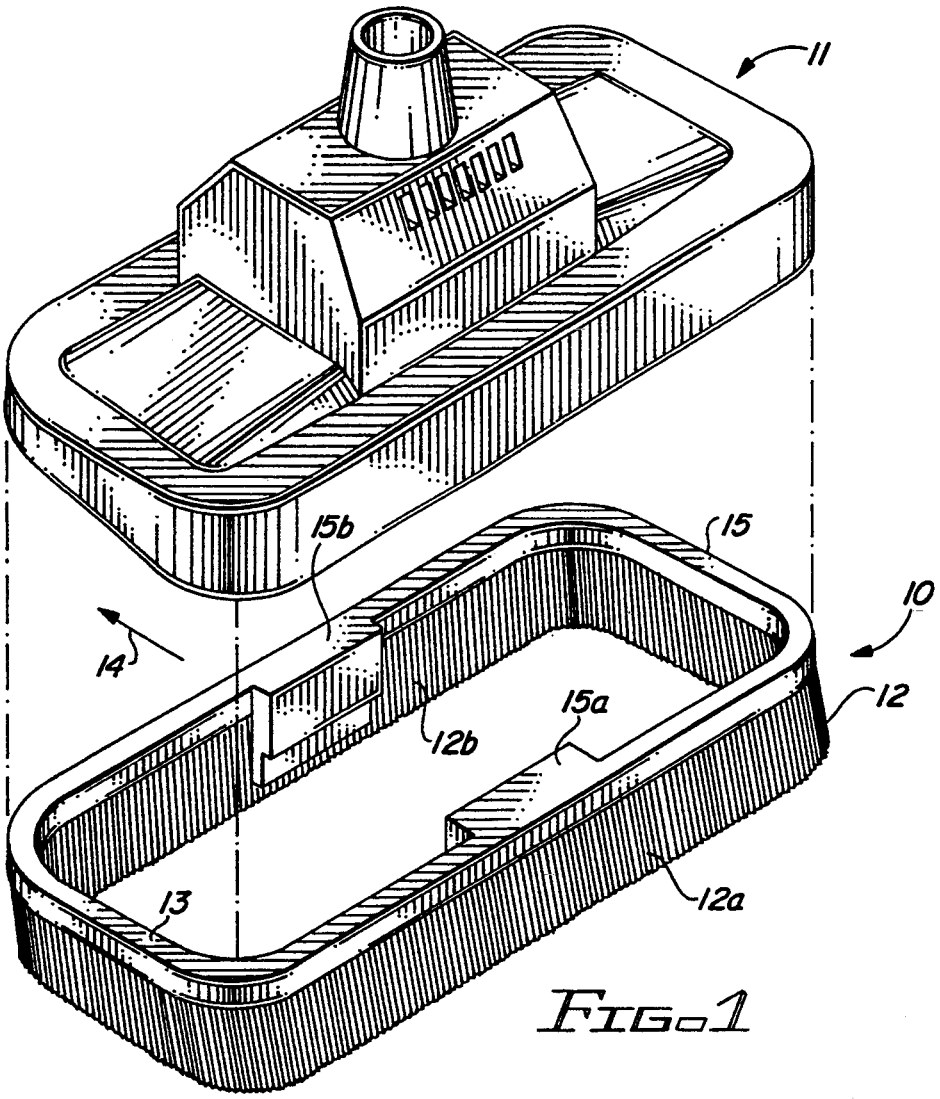
FIG. 1 is an exploded perspective view of a cleaning device.

Referring to the drawings a peripheral skirt formation 10 for a swimming pool cleaner of the like comprises a peripheral downwardly depending curtain of bristles 12 which surround the lower extremity of a body of the cleaning device shown at 11. The cleaning device is of a type which performs oscillating to and fro motions with the bristles of the curtain 12 angled rearwardly to cause pulsating forward movement of the device in the direction of the arrow 14.

It is a feature of the invention that the leading edge of the oblong shape of the bristle curtain will be a linear straight edge disposed substantially at right angles to the direction of movement of the cleaning device. Preferably the rear edge will likewise be a straight edge as shown in FIG. 1. It has been found that the straight, front and rear edges of the bristle curtain enhances the mobility and climbing ability of the cleaning device.

A further feature of the invention provides for the bristle curtain 12 at the leading edge **12*a* to be angled rearwardly relative to the movement of the cleaning device, to a lesser degree than the bristle curtain at the trailing edge 12*b* of the curtain 12. The bristles at the leading and the trailing edge 12*a* and 12*b* of the curtain 12 are both angled rearwardly relative to the direction of movement 14 of the cleaning device 11** as stated above. By angling the bristles in such a manner, the oscillating to and fro movement of the device is translated into forward movement as the bristles tend to resist rearward movement but permit forward movement.

Thus in a preferred arrangement the bristles at the leading edge **12*a* will be angled rearwardly out of the vertical by approximately 8°, while those at the trailing edge 12*b*** will be angled at approximately 18° out of the vertical. It will be appreciated that variations are possible and the invention includes within its scope arrangements wherein the bristles in the leading edge are angled between 0° and 15° while those in the trailing edge may be angled between 8° and 30° with the proviso that those at the leading edge will be angled to a lesser degree than those at the trailing edge as stated above.

It has been found that by the differential angle of the bristles in the leading and trailing edges, enhances the climbing ability of a cleaning device through an upwardly radiased curved surface, the climbing ability of the cleaning device is further enhanced by the linear leading and trailing edges of the skirt formation as mentioned above.

Figure 4:
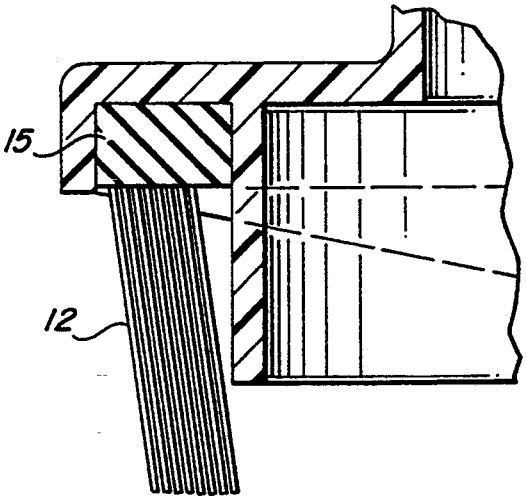
FIG. 4 is a section on line IV—IV in FIG. 2.
Figure 2:
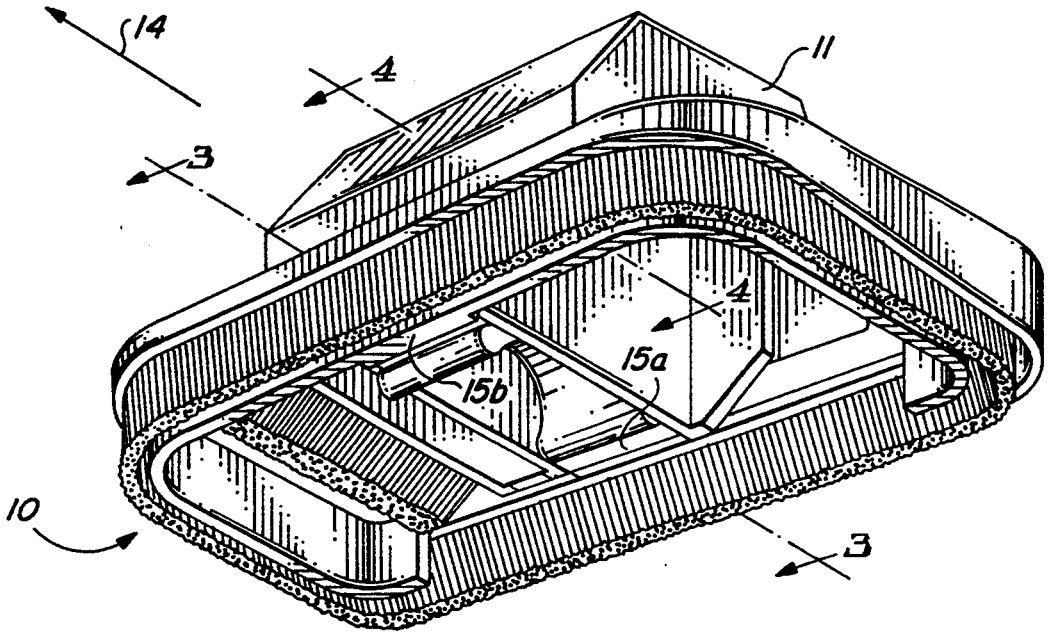
FIG. 2 is a perspective view from below of the device in FIG. 1.
Figure 3:
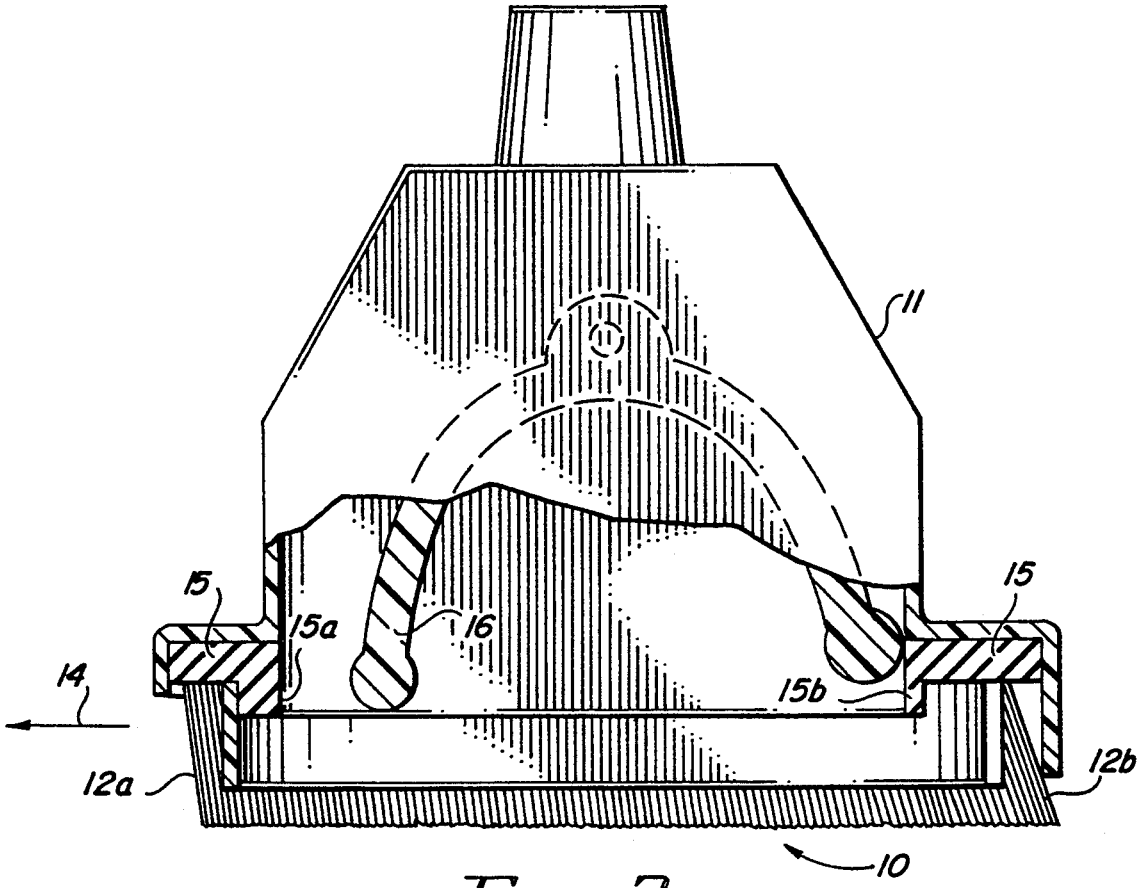
FIG. 3 is a section on line III—III in FIG. 2.

In a preferred construction of the skirt formation 10, the bristles will be secured to an oblong ring-like holder 15 which could for example be in the form of a plastic casting. It is envisaged that the holder 15 will removably secured to the body 11 of the cleaner to permit replacement. With reference to FIG. 4, the holder 15 could for example engage in a groove 17 defined by the body 11, in clip-in fashion. The ring-like holder 15 is further characterised in opposed buffer formations **15*a* and 15*b* against which an oscillator 16 of the cleaning device will strike as it performs oscillating movements to cause movement of the cleaning device as a whole. The buffer formations 15*a* and 15*b* will preferably be integrally formed with the holder 15, but alternatively they could be in the form of replaceable elements. It has been found that sufficient strength is imparted to the cleaning device securing or integrally forming the buffer formations 15*a*, 15*b*, with the holder 15. Flexing of the holder 15 as a result of the striking action of the oscillator 16**, will also enhance mobility of the cleaning device.

Variations of the invention in detail may exist and it is intended that these should fall within the scope of the consistory clauses.

What is claimed is:

1. A submersible swimming pool cleaner for cleaning a submerged surface comprising:

an elongated, hollow cleaner body having a front, a rear and a generally horizontal bottom and having an oscillator with opposing sides pivotally mounted within the body for engaging in an oscillatory to and fro movement in response to fluid flow past the oscillator so that said opposing sides of the oscillator impact with said cleaner body during use to thereby impart motion to the cleaner, said cleaner body including an opening in the bottom;

first and second opposed plastic buffer means, each buffer means inserted between said cleaner body and an adjacent side of said oscillator for receiving and buffering alternate impacts from the oscillator;

surface engaging means extending generally vertically from the bottom and at least partially surrounding the opening, said surface engaging means forming a linear forward portion adjacent the front of the cleaner body and a rearward portion adjacent the rear of the cleaner body, said forward portion of the surface engaging means extends rearwardly from the bottom at a first angle from vertical and said rearward portion of the surface engaging means extends rearwardly from the bottom at a second angle from vertical that is greater than said first angle when said surface engaging means is in an unbiased position so as to enhance the climbing ability of the cleaner through a radiased curve; and wherein the oscillator and the surface engaging means cooperate together during operation of the cleaner so that the cleaner body only moves in a forward motion with the front leading the cleaner body in that forward motion.

2. The submersible swimming pool cleaner recited in claim 1 wherein the opposing sides of the oscillator each extend to an extremity and each of the first and second buffer means is positioned between the cleaner body and an extremity of the adjacent side of the oscillator.

3. The submersible swimming pool cleaner recited in claim 2 wherein each of the first and second buffer means is attached to the cleaner body.

4. The submersible swimming pool cleaner recited in claim 1 wherein the oscillator is pivotally mounted in the cleaner body on a pivot axis which extends generally longitudinally along the body.

5. The submersible swimming pool cleaner recited in claim 4 wherein the pivot axis is lateral to said forward motion imparted to the cleaner body by the oscillatory to and fro movement.

6. The submersible swimming pool cleaner recited in claim 5 wherein each of the first and second plastic buffer means includes a substantially flat surface, each substantially flat surface extending generally parallel to the pivot axis of the oscillator.

7. The submersible swimming pool cleaner recited in claim 1 wherein the surface engaging means comprises plural bristles.

8. The submersible swimming pool cleaner recited in claim 7 wherein said bottom defines a periphery thereabout and said plural bristles extend about the periphery of said bottom.

* * * * *

UNITED STATES PATENT AND TRADEMARK OFFICE
Certificate

Patent No. 5,386,607 Patented: February 7, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Pavel Sebor, Johannesburg, Transvall, South Africa; Dieter J. Rief, Santa Rosa, CA; and Herman Frentzel, Sausalito, CA.

Signed and Sealed this Thirteenth Day of September 2005.

JILL WARDEN
*Supervisory Patent Examiner*
Art Unit 1743